US005746663A

United States Patent [19]

Calace

[11] Patent Number: 5,746,663

[45] Date of Patent: May 5, 1998

[54] GOLFING AND BATTING AID

[76] Inventor: Michael A. Calace, 3054 Olive View Rd., Alpine, Calif. 91901

[21] Appl. No.: 884,135

[22] Filed: Jun. 27, 1997

[51] Int. Cl.[6] ..... A63B 69/36

[52] U.S. Cl. ..... 473/211; 473/215; 473/275; 473/458

[58] Field of Search ..... 473/208, 211, 473/215, 274, 275, 458

[56] References Cited

U.S. PATENT DOCUMENTS 1,126,051 1/1915 McGillicuddy ..... 473/208
4,300,765 11/1981 Stringham ..... 473/458

*Primary Examiner*—George J. Marlo
*Attorney, Agent, or Firm*—Peter A. Borsari

[57] ABSTRACT

A golfing and batting aid is provided which enables a user to maintain a proper head position while executing the swinging of a golf club or baseball bat. The golfing and batting aid comprises a mouthpiece, a rigid support bar which is configured to extend away from the mouthpiece and towards the rear of the user's head and an inflexible connecting member which connects the rigid support element to the belt loop or waistband of a user. In operation, the user bites down on the mouthpiece and adjusts the connecting member such that it is sufficiently taut to prevent the user from moving his head while executing a swing.

16 Claims, 2 Drawing Sheets

GOLFING AND BATTING AID

FIELD OF INVENTION

The present invention generally relates to the field of golfing and batting aids. More particularly, the present invention relates to a device which enables the user to maintain a proper head position while executing the swinging of a golf club or baseball bat.

BACKGROUND OF THE INVENTION

Devices designed to assist people in developing and maintaining a proper golf swing or bat swing are numerous and well known in the prior art. Among such devices are aids which are designed to maintain proper head position. For example, U.S. Pat. 1,126,051 to McGillicuddy discloses a golfing aid which deters a user from raising or turning his head comprising a mouthpiece, an elastic member tethered to the mouthpiece at one end and attached to a belt at the other end. The belt is worn about the torso of the user, just under the arms. In use, the McGillicuddy device is situated along the front side of the user, thereby potentially interfering with the user's sight line. In addition, this device provides an elastic member which is capable of stretching, thereby allowing the user to raise or turn his head to some degree. Moreover, the McGillicuddy device includes a torso belt which can cause discomfort and interference with the user's swing. U.S. Pat. No. 5,174,564; to Young discloses a swinging and hitting training device for golf and baseball comprising a mouthpiece having elastic straps which are connected to the clothing of a user, particularly a user's belt. The elastic straps are provided with buckles which allow the straps to be adjusted in length. The straps, while providing some resistance when the user moves his head, do not prevent the user from turning or lifting his head. U.S. Pat. No. 3,059,932 to Smallwood, U.S. Pat. No. 4,746,118 to Deveney and U.S. Pat. No. 5,118,104 to DeLanzo all provide swinging aids having a cumbersome head engaging member such as a helmet which is worn by the user.

Despite the teachings of the prior art which disclose devices for teaching and maintaining golf or batting swings, a need still exists for a device which locks the user's head into the proper position when executing a golf or batting swing. Such a device should be compact and comfortable, simple to use and inexpensive to manufacture.

SUMMARY OF THE INVENTION

Accordingly, it is an object of the present invention to provide a golfing and batting aid which aids the user in maintaining proper head position while swinging a golf club or baseball bat.

It is another object of the present invention to provide a golfing and batting aid which locks the user's head into a set position and prevents the user from turning or lifting his head out of the "eyezone".

It is still another object of the present invention to provide a golfing and batting aid which can be used during the playing of golf or baseball.

It is a further object of the present invention to provide a golfing and batting aid which can be used for developing muscle motor memory during practice or warm-up periods.

It is an additional object of the present invention to provide a golfing and batting aid which is easy to put on and easy to take off.

It is also an object of the present invention to provide a golfing and batting aid which is comfortable to wear, uncumbersome and does not interfere with the user's line of vision.

It is yet another object of the present invention provide a golfing and batting aid which can be used by any golfer or batter regardless of height, weight or other physical dimension.

It is still another object of the present invention to provide a golfing and batting aid which is inexpensive to manufacture.

Additional objects, advantages and novel features of the invention will be set forth in part in the description which follows, and in part will become apparent to those skilled in the art upon examination of the following specification or may be learned by practice of this invention.

These and other objects of the invention, as embodied and broadly described herein, are achieved by providing a device comprising a mouthpiece, a rigid supporting element extending from said mouthpiece and an inflexible connecting member attached to said rigid supporting element and having means for attachment to a person's clothing.

BRIEF DESCRIPTION OF THE DRAWINGS

The present invention will be better understood with reference to the appended drawing sheets, wherein.

DETAILED DESCRIPTION

Figures 1, 2:
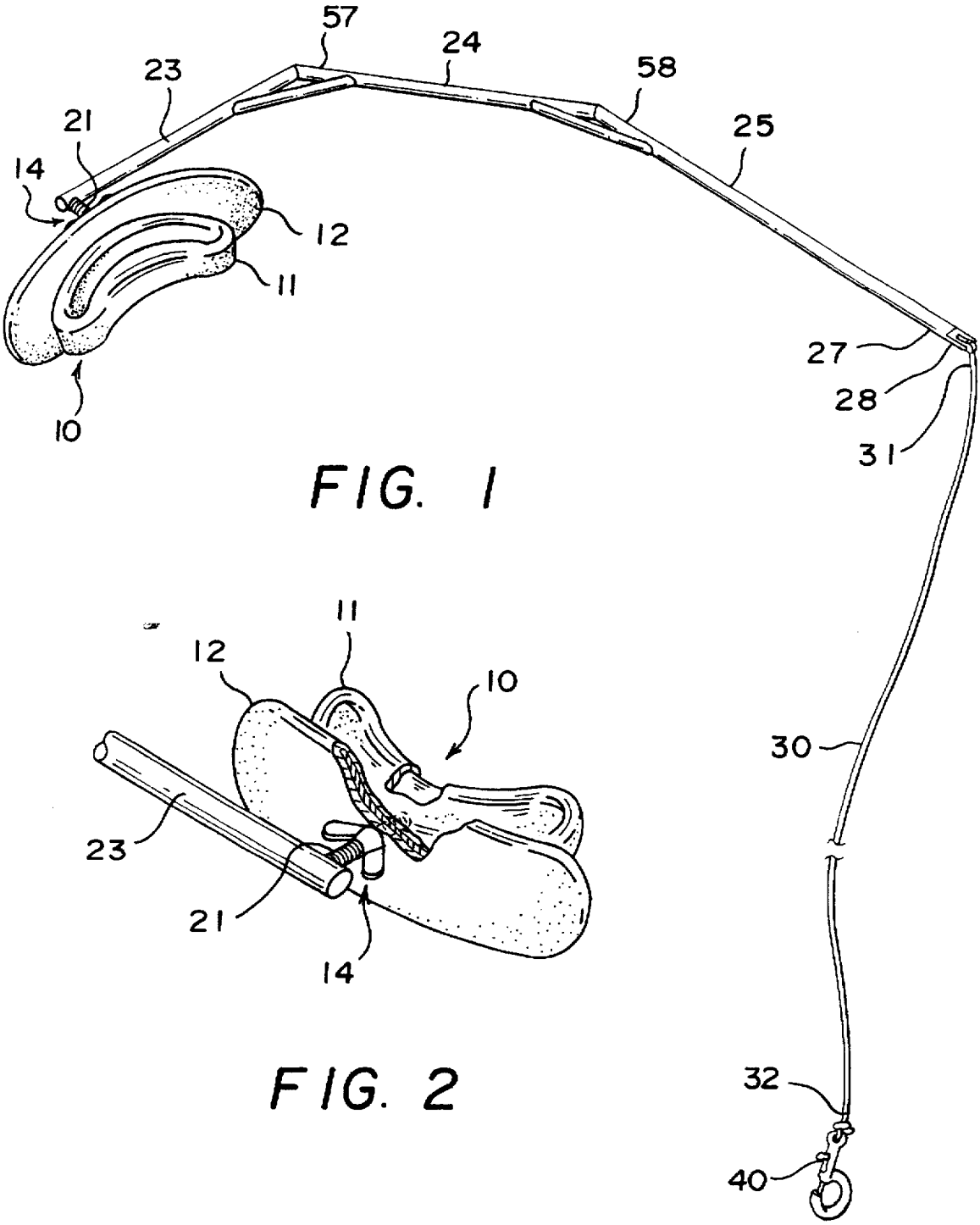
FIG. 1 shows a side perspective view of the golfing and batting aid of the present invention.
FIG. 2 shows a side perspective view of golfing and batting aid illustrating one embodiment of the attachment of the mouthpiece to the rigid support element.

The present invention relates to a device which enables the user to maintain a proper head position while executing the swinging of a golf club or baseball bat. As shown in FIG. 1, the device 1 comprises a mouthpiece 10, a rigid support bar 20, an inflexible connecting member 30 and attachment means 40. The mouthpiece 10 includes a bite plate 11, an outer cover plate 12 and fastening means 14 for securing the rigid support bar 20 thereto. The bite plate 11 may be in the form of any conventional mouthpiece well known in the prior art which can be bitten down upon and held between the teeth and lips.

Preferably, the bite plate is kidney-shaped such that it can be comfortably inserted and held within the mouth. The bite plate may be composed of rubber or hard plastic. Preferably, the bite plate is composed of a metal, such as steel or aluminum, having a replaceable rubber sheath. The outer cover plate 12 is fashioned to fit over the user's mouth once the bite plate is inserted into the mouth. The outer cover plate also may be composed or rubber, hard plastic or a metal having a rubber or plastic sheath.

The mouthpiece 10 may be secured to the rigid supporting bar 20 by permanent means or by detachable means. For example, fastening means 14 can be a welding of the mouthpiece to the rigid supporting element during the manufacturing process, although it is to be understood that any conventional fastening means is within the scope of this invention. In the embodiment shown in FIGS. 1 and 2, the mouthpiece is detachably secured to the rigid support bar 20 by threaded engagement. In this embodiment, fastening means 14 is in the form of a threaded aperture disposed within the center of the mouthpiece which cooperatively engages threaded element 21 extending from the proximal end of rigid support bar 20. Preferably, threaded element 21 is in the form of a double male threaded screw which also engages a threaded aperture disposed within the proximal end of said rigid support bar 20. This type of fastening means not only secures the mouthpiece to the rigid support bar, but also provides vertical adjustment of the rigid support bar such that the rigid support bar is in a low and comfortable position, either touching the user's shoulder or slightly above the user's shoulder. Vertical adjustment of the device is achieved by using a wing nut or similar fastener to retain the threaded element 21 at a fixed position vis-a-vis the mouthpiece. Although a threaded element 21 is illustrated in the drawings, it is to be understood that other suitable means for detachably securing the mouthpiece to the rigid support bar are within the scope of the present invention.

Rigid support bar 20 is in the form of a metal bar which is angled in such a manner that it extends away from the mouthpiece 10 and towards the rear of the user's head. The angulation of the metal bar can be devised in any number of ways, as will be obvious to one skilled in the art. For example, the metal bar can be "L"-shaped, the shorter leg being attached to the mouthpiece and the longer end extending over the user's shoulder. However, in order to prevent or diminish excessive stress on the bar, particularly at each angle, it is preferred that the angulation of the metal bar comprises at least three legs or sections as shown in FIG. 1. Such an arrangement spreads the force exerted on the bar over the several legs and angles, and also generates less stress on the mouthpiece. In the embodiment shown in FIG. 1, the rigid support bar 20 comprises two angular bends $a^1$ and $a^2$, defining three legs or sections 23, 24 and 25, section 23 being the proximal leg or first leg, section 24 being a middle leg and section 25 being the distal or end leg. The two angular bends are configured in such a manner that the distal end leg 25 is disposed towards the rear of the user's head (either resting on the user's shoulder or lying in a plane slight above the user's shoulder), once the mouthpiece has been inserted in the user's mouth. The two angular bends $a^1$ and $a^2$ may be equal bends, for example in the range of about 45° to about 65°. However, it is to be understood that the precise angle of each bend may be varied depending on design and manufacturing considerations. Further, it is not required that the total sum of angular bends equal a fixed sum. Rather, the angular bends must be configured such that distal end of leg 26 is located behind the user's head in operation.

Although the invention depicted in the Figures illustrates a rigid support element having two angular bends forming three distinct legs, it is to be understood that the invention is not limited to a rigid support element having three bends and four legs. Rather, the present invention contemplates a rigid support element having as few as one angular bend forming two distinct legs, or three or more angular bends forming a plurality of legs, with the proviso that the distal end of the rigid support element is directed towards the rear of the user's head.

Figure 3:
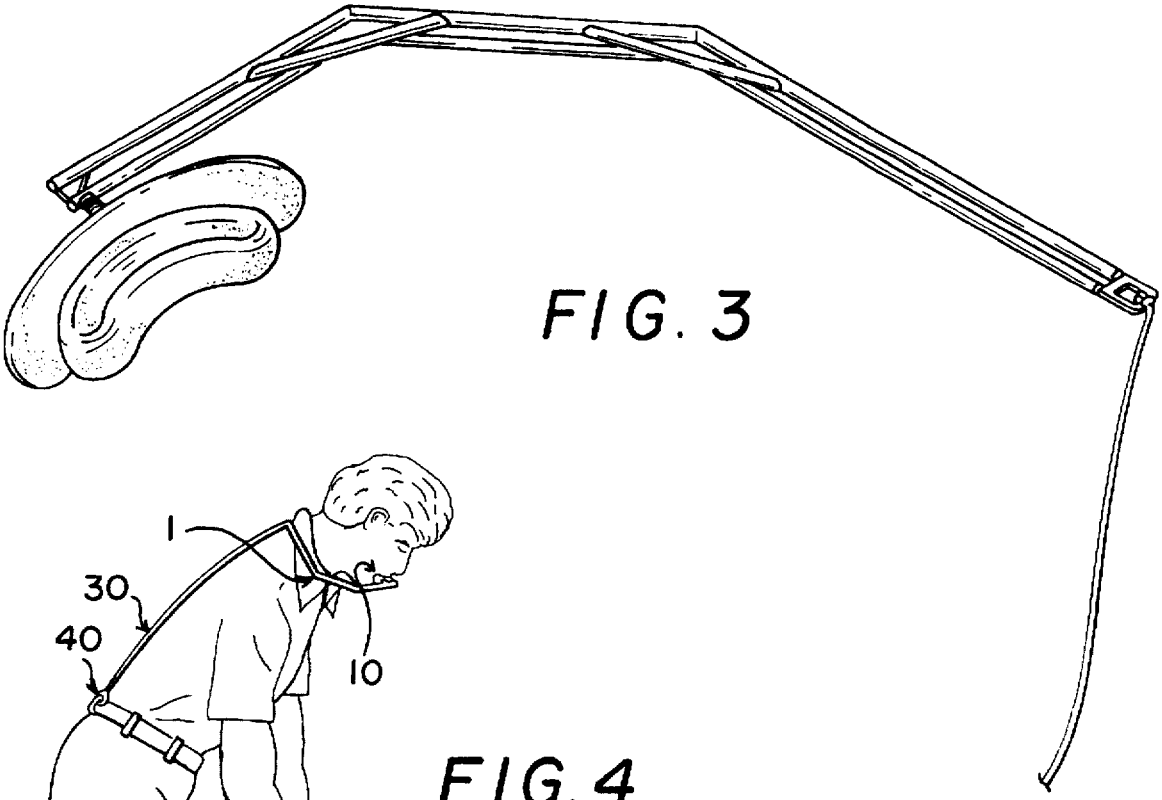
FIG. 3 shows a side perspective view of an alternative embodiment of the golfing and batting aid of the present invention.
Figure 4:
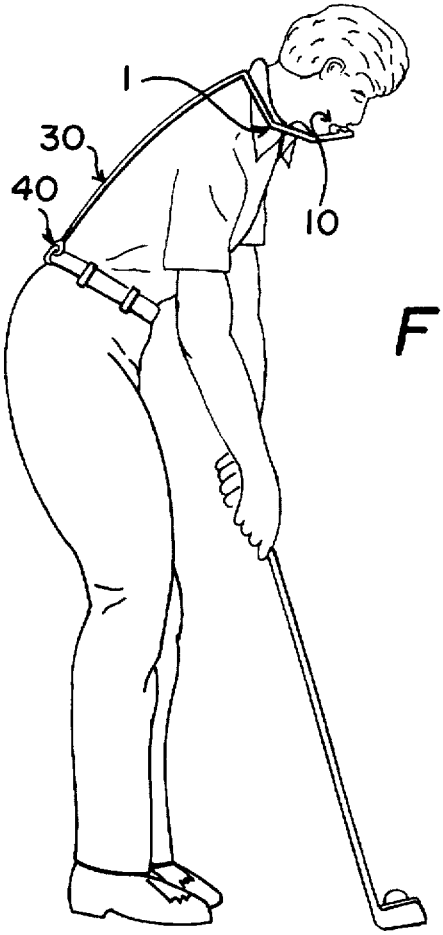
FIG. 4 shows a side perspective view of the golfing and batting aid as worn by a golfer executing a golf swing.
Figure 4A:
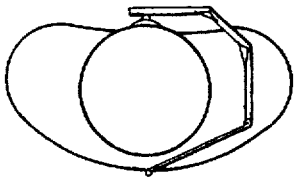
FIG. 4A shows a top view of the golfing and batting aid as worn by a golfer executing a golf swing.

The rigid support bar 20 may be composed of any suitable material, including for example, steel or aluminum, having sufficient strength and durability such that is remains rigid and stable during use. That is, the rigid support element should be composed of a material that is inflexible and yet will not snap or break during use. Although it is contemplated that the rigid support bar 20 be composed of a metal material, it is to be understood that any material having these characteristics may be used. Preferably, the rigid support bar 20 is a solid metal tube which may be sheathed in rubber or plastic. In an alternative embodiment shown in FIG. 3, the rigid support bar 20 is in the form of twin support bars 20A and 20B which are connected by reinforcing support elements as discussed below.

Continued use of the golfing and batting aid of the present invention may cause wear in the rigid support bar 20, particularly at the angular bends $a^1$ and $a^2$. Thus in a preferred embodiment shown in FIG. 1, the rigid support bar may be reinforced in order to provide additional strength to the support element during use. One means of reinforcing the support element 20 is by providing reinforcing support elements 27 and 28, at each of the angular bends. In the embodiment shown in FIG. 3, the reinforcing support elements not only diminish the stress exerted on the support bar, but also permanently connects the twin support bars 20A and 20B.

Disposed at the distal end 27 of leg 25 is means for attaching connecting member 30 to the rigid support bar 20. In the embodiment shown in FIG. 1, an eyelet opening 28 is provided for fastening the connecting member 30. Connecting member 30, having a first end 31 and a second end 32, is composed of an inflexible material which will not yield or stretch when pulled. Numerous materials are suitable for use as the connecting member 30 as will be obvious to those skilled in the art, examples of which include, rope, plastic coated rope, nylon rope, nylon strap, nylon band, plastic coated steel cable and the like. Various means may be utilized for fastening connecting member 30 to rigid support element 30. For example, first end 31 of connecting member 30 can be knotted through eyelet opening 28. Alternatively, first end 31 may be provided with a hook, clasp or similar fastener capable of engaging eyelet opening 28.

The second (or distal) end of connecting member 30 is provided with attachment means 40 for securing the connecting member to the body of a person, preferably to the belt or waistband of the user and more preferably to a center belt loop. Any conventional attachment means may be used for this purpose, including for example, a C-clasp, a clamp, a sliding brace or the like.

In operation, a right-handed user bites down on mouthpiece 10 and positions the rigid support bar 20 over his right shoulder (a left handed user would position the rigid support bar 20 over his left shoulder). The user then clasps attachment means 40 to the belt or belt loop at the direct center of his back such that connecting member 30 is taut and touches the top of the shoulder blade. When the connecting member is knotted to eyelet opening 38, the user first must knot the connecting member at a point which provides a taut fit. The connecting member should be sufficiently taut that a golfer's head is positioned down, kept straight and prevented from turning or lifting his head out of the "eyezone" and beyond the point needed for a successful swing. For a batter, the head should be positioned up and turned toward the pitcher. For either sportsman, the present invention results in enabling the user to maintain his eyes on the ball, rather than turning his head out of the strike zone or sneaking a peak off the golf tee.

While particular embodiments of the invention have been described, it will be understood, of course, that the invention is not limited thereto, and that many obvious modifications and variations can be made, and that such modifications and variations are intended to fall within the scope of the appended claims.

What is claimed is:

1. A golfing and batting aid for enabling a user to maintain proper head position while executing the swinging of a golf club or baseball bat comprising:

a mouthpiece;

a rigid support bar having a proximal end connected to said mouthpiece by fastening means, and a distal end;

an inflexible connecting member having a first end and a second end, said first end having securing means for attachment to said distal end of said rigid support bar and said second end having attachment means for engaging a user's belt or waistband;

wherein said rigid support bar is configured in such a manner that it extends away from said mouth piece and towards the rear of said user's head.

2. The golfing and batting aid in accordance with claim 1, wherein a threaded aperture is disposed in said mouthpiece and in said proximal end of said rigid support bar and wherein said fastening means is a double male threaded element which engages each threaded aperture.

3. The golfing and batting aid in accordance with claim 1, wherein said fastening means is capable of providing vertical adjustment of the rigid support bar in relation to said mouthpiece.

4. The golfing and batting aid in accordance with claim 1, wherein said rigid support bar is configured with at least one angular bend defining at least two legs.

5. The golfing and batting aid in accordance with claim 4, wherein said rigid support bar comprises two angular bends defining three legs, said three legs being a proximal end leg, a middle leg and a distal end leg.

6. The golfing and batting aid in accordance with claim 5, wherein each of said two angular bends are reinforced with a support element.

7. The golfing and batting aid in accordance with claim 4, wherein said rigid support bar is composed of a material which is inflexible and sufficiently durable that it will not snap or break during use.

8. The golfing and batting aid in accordance with claim 7 wherein said rigid support bar is in the form of a solid metal tube.

9. The golfing and batting aid in accordance with claim 8, wherein said solid metal tube is sheathed in a rubber or plastic material.

10. The golfing and batting aid in accordance with claim 7, wherein said rigid support bar is in the form of a pair of solid metal tubes.

11. The golfing and batting aid in accordance with claim 4, wherein said at least one angular bend is reinforced with a support element.

12. The golfing and batting aid in accordance with claim 1, wherein said inflexible connecting member is selected from the group consisting of rope, plastic coated rope, nylon rope, nylon strap, nylon band and plastic coated steel cable.

13. The golfing and batting aid in accordance with claim 1, wherein an eyelet opening is disposed in said distal end of said rigid support bar which engages said securing means of said first end of said inflexible connecting member.

14. The golfing and batting aid in accordance with claim 13, wherein said securing means is formed by looping said inflexible connecting member through said eyelet opening and tieing a knot.

15. The golfing and batting aid in accordance with claim 13, wherein said securing means is in the form of a hook or clasp capable of engaging said eyelet opening.

16. The golfing and batting aid in accordance with claim 1, wherein said attachment means is in the form of a C-clasp, clamp or sliding brace capable of engaging a user's belt loop or waistband.

* * * * *